US006863285B2

(12) United States Patent
Gonthier

(10) Patent No.: US 6,863,285 B2
(45) Date of Patent: Mar. 8, 2005

(54) DEVICE FOR RETAINING A BOOT ON A GLIDING, ROLLING, OR WALKING BOARD ADAPTED TO A SPORTING ACTIVITY, AND THE BOOT THEREFOR

(75) Inventor: Jean-François Gonthier, Viuzla Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/968,949

(22) Filed: Oct. 3, 2001

(65) Prior Publication Data

US 2002/0041081 A1 Apr. 11, 2002

(30) Foreign Application Priority Data

Oct. 6, 2000 (FR) ..... 00 13032

(51) Int. Cl.[7] ..... A63C 11/16

(52) U.S. Cl. ..... 280/14.22; 280/636; 36/117.1

(58) Field of Search ..... 280/14.22, 14.24, 280/11.36, 611, 619, 623, 624, 634, 636; 36/117.1

(56) References Cited

U.S. PATENT DOCUMENTS

| | | | | | |
|---|---|---|---|---|---|
| 2,819,907 | A | | 1/1958 | Thoresen | 280/87.042 |
| 3,801,119 | A | | 4/1974 | Andre | 280/11.35 K |
| 4,268,062 | A | | 5/1981 | Wittmann | 280/618 |
| 4,284,292 | A | | 8/1981 | Faulin | 280/618 |
| 4,542,599 | A | * | 9/1985 | Annovi | 36/117.4 |
| 5,261,689 | A | * | 11/1993 | Carpenter et al. | 280/618 |
| 5,752,331 | A | * | 5/1998 | Perrissoud et al. | 36/117.1 |
| 5,894,684 | A | | 4/1999 | Sand et al. | 36/117.1 |
| 5,901,971 | A | * | 5/1999 | Eaton | 280/14.2 |
| 5,946,827 | A | | 9/1999 | Okajima | 36/58.5 |
| 5,967,531 | A | | 10/1999 | Saillet | 280/11.36 |
| 6,017,042 | A | | 1/2000 | Paris | 280/14.2 |
| 6,076,848 | A | | 6/2000 | Rigal et al. | 280/634 |
| 6,102,429 | A | * | 8/2000 | Laughlin et al. | 280/617 |
| 6,123,342 | A | | 9/2000 | Grell | 280/11.36 |
| 6,206,403 | B1 | * | 3/2001 | Black et al. | 280/618 |
| 6,231,057 | B1 | | 5/2001 | Reuss et al. | 280/14.21 |
| 6,267,403 | B1 | * | 7/2001 | Bossin et al. | 280/625 |
| 6,347,805 | B1 | * | 2/2002 | Maravetz et al. | 280/624 |
| 6,394,484 | B1 | * | 5/2002 | Maravetz et al. | 280/624 |
| 6,520,511 | B2 | | 2/2003 | Gonthier | 280/11.36 |
| 2001/0010418 | A1 | | 8/2001 | Gonthier | 280/11.3 |
| 2002/0153699 | A1 | * | 10/2002 | Okajima | 280/613 |

FOREIGN PATENT DOCUMENTS

| | | |
|---|---|---|
| DE | 2802251 | 7/1979 |
| EP | 0797936 | 10/1997 |
| EP | 0985357 | 3/2000 |
| EP | 1247552 | 10/2002 |
| FR | 2822716 | 10/2002 |
| GB | 28793 | 2/1898 |
| WO | WO98/31247 | 7/1998 |
| WO | WO00/21618 | 4/2000 |

* cited by examiner

*Primary Examiner*—Christopher P. Ellis
*Assistant Examiner*—Jeff Restifo
(74) *Attorney, Agent, or Firm*—Greenblum & Bernstein, P.L.C.

(57) ABSTRACT

A device for retaining a boot on a board adapted to a sporting activity, and a boot therefor. The device includes a base, a lateral edge, a rear support element, and at least one linkage for holding the boot above the base. The edge and the rear support element each have an inner surface. One or several of the inner surfaces of the device has at least one friction plate that projects at least partially with respect to the inner surface, the fiction plate being provided at least to oppose a movement of the boot in relation to the base.

43 Claims, 4 Drawing Sheets

DEVICE FOR RETAINING A BOOT ON A GLIDING, ROLLING, OR WALKING BOARD ADAPTED TO A SPORTING ACTIVITY, AND THE BOOT THEREFOR

CROSS-REFERENCE TO RELATED APPLICATIONS

This application is based upon French Patent Application No. 00 13032, filed Oct. 6, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to the field of devices for retaining a boot on a gliding, rolling, or walking board adapted to a sporting activity, as well as to a boot adapted to be retained by the device.

2. Description of Background and Relevant Information

Devices of the aforementioned type are used in snowboarding, skiing, skateboarding, roller skating, snowshoeing, and the like.

Certain binding devices are provided to retain flexible boots on the board, while others are provided to retain rigid boots.

In the case of flexible boots, in snowboarding, for example, a device generally includes a base provided for receiving at least partially the sole of the boot, at least one lateral edge connected to the base so as to be opposite lateral portions of the boot, a rear support element provided to receive the boot upper at the rear of the user's lower leg, and at least one linkage for holding the boot above the base, the edge and the rear support element each having an inner surface provided to be opposite the boot.

Such a device retains the boot on the board during string by the rider/user.

However, it has been found that during steering, the boot makes small displacements within its retention volume on the device. These small displacements hinder the accuracy of the steering of the board.

SUMMARY OF THE INVENTION

An object of the present invention is to reduce the frequency and/or the amplitude of the aforementioned displacements.

To this end, the invention proposes a device for retaining a boot on a gliding, rolling, or walking board adapted to a sporting activity, the device including a base provided to receive at least partially the sole of the boot, at least one lateral edge connected to the base so as to be opposite lateral portions of the boot, a rear support element provided to receive the boot upper at the rear of the user's lower leg, and at least one linkage for holding the boot above the base, the edge and the rear support element each having an inner surface provided to be opposite the boot.

One or several of the inner surfaces of the retaining device of the invention has at least one friction plate that projects at least partially with respect to the inner surface, the friction plate having friction surface or a friction means provided at least to oppose movement, such as spacing, of the boot from the base.

The boot of the invention has at least one friction plate that projects at least partially with respect to a lateral portion of the sole and/or with respect to a portion of the upper.

As a result of the friction-increasing structure according to the invention, i.e., whereby the friction between the boot and the retaining device is increased compared to the friction between the boot and the retaining device without such structure, the boot sole tends to remain in support on the base. Therefore, the boot upper tends to remain immobile with respect to the device. Consequently, the small displacements of the boot within its retaining volume on the device are reduced. This advantageously makes the steering of the board more accurate.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The first embodiment is described hereinafter with reference to FIGS. 1–4.

Figure 1:
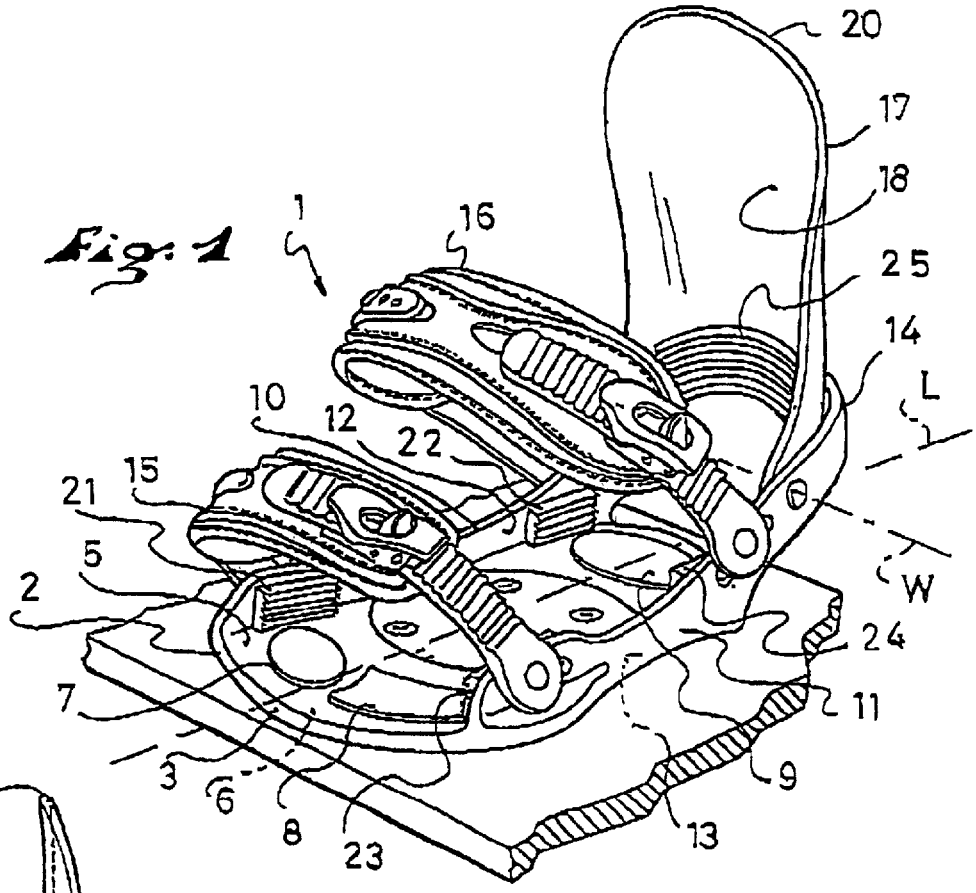
FIG. 1 is a perspective view of a device for retaining a boot on a board, according to a first embodiment of the invention.

A device 1 for retaining a boot on a board is shown in perspective in FIG. 1.

For reasons of convenience, the boot is not shown, although its position with respect to the retention device is readily apparent to those skilled in the art.

In a known manner, the device 1 includes a base 2 provided to receive at least partially the sole of a boot. The base 2 has a front end 3 and a rear end 4 which demarcate its length, along a longitudinal direction L of the device 1. The base 2 has an upper surface 5 provided to be opposite the sole, as well as a lower surface 6 provided to be opposite the board.

The longitudinal direction L of the device 1 is the same as that of the boot, when the latter is retained on the device 1.

Preferably, the base 2 is provided with front pads 7, 8 and a rear pad 9 which project, respectively, in relation to the upper surface 5. Each pad 7, 8, 9 is affixed to the base by a means such as nesting, gluing, or the like. The pads are provided to receive the boot sole.

The device 1 also has a first lateral edge 10 and a second lateral edge 11. The edges 10, 11 are connected to the base 2 so that their respective inner surfaces 12, 13 are opposite lateral portions of the boot. The edges 10, 11 are oriented substantially along the longitudinal direction L. The edges 10, 11 preferably form a unitary piece with the base 2, but they could also be fixed to the base 2 or journalled with respect to the base along a longitudinal axis.

Preferably, an arch 14 connects the lateral edges 10, 11 to one another toward the rear end 4 of the base 2.

Retaining elements, shown in the form of linkages 15, 16, are provided to removably retain the boot on the device 1. The linkages 15, 16, which can be opened or closed by the user, connect the lateral edges 10, 11, respectively.

A rear support element 17 is affixed to the base 2 by a means shown in the form of a journal on the lateral edges 10, 11. The journal occurs along a transverse axis W of the device 1.

The rear support element 17 has an inner surface 18 having a forwardly facing concave shape to receive the boot upper at the rear of the user's lower leg.

Figure 2:
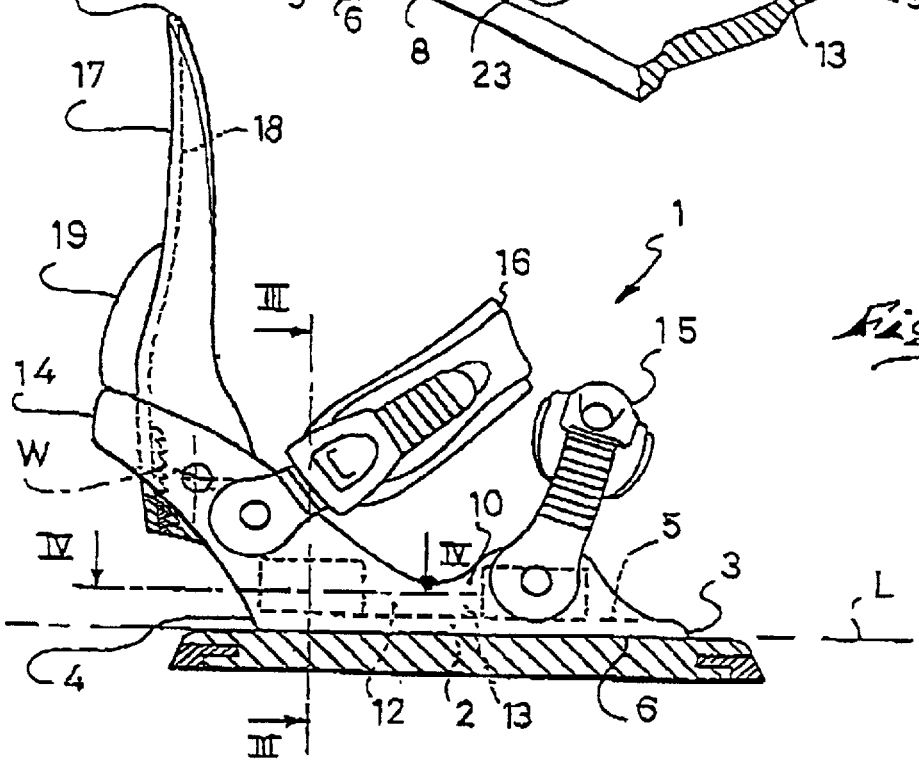
FIG. 2 is a side view of the device of FIG. 1.

FIG. 2 shows additional aspects of the device 1.

An abutment 19, adjustably affixed by any means to the rear support element 17, limits a rotation of the latter along the transverse axis W. When the abutment 19 is in support on the arch 14, an upper end 20 of the rear support element 17 can move no farther away from the front end 3 of the base 2.

In this case, the user can take rear support with the lower leg by pressing on the inner surface 18 along the longitudinal direction L.

According to the invention, as seen better in FIG. 1, a first friction plate 21 and a second friction plate 22 project, at least partially, with respect to the inner surface 12 of the first lateral edge 10.

Similarly, a third plate 23 and a fourth plate 24 project with respect to the inner surface 13 of the second lateral edge 11, and a fifth plate 25 projects with respect to the inner surface 18 of the rear support element 17.

Each of the plates 21, 22, 23, 24, 25 includes a friction surface or friction means provided to oppose a separation, or spacing, of the boot sole with respect to the upper surface 5 of the base 2.

For reasons of convenience, only the second plate 22 is described in detail hereinafter with reference to FIGS. 3 and 4.

Figure 3:
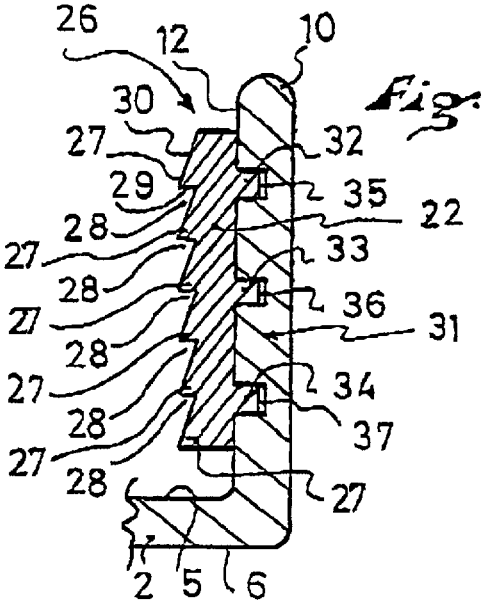
FIG. 3 is a cross-section along the line III—III FIG. 2.

As seen clearly in FIG. 3, the friction means are obtained by alternating projections and recesses arranged on a friction surface 26 of the second plate 22.

Preferably, each projection is formed by a tooth 27 which extends over the surface 26, substantially parallel to the upper surface 5 of the base 2.

The surface 26 thus includes a series of several teeth 27 separated by grooves 28.

The teeth 27 are provided to cooperate with a lateral portion of the boot as follows, when this portion is in support on the friction surface 26 of the plate 22.

The shape of the teeth enables a sliding of the boot toward the base 2, but opposes a spacing of the boot from the base, in the manner of fish scales against water.

To this end, each tooth has a particular geometry. A tooth 27 has a first surface 29 substantially parallel to the base 2, as well as a second surface 30 which forms, together with the first surface, an angle comprised between 10 and 80 degrees.

For a given tooth, the second surface 30 is farther from the base 2 than the first surface 29.

The top of each tooth, defined by the edge coming from the intersection of the first surface 29 with the second surface 30, tends to penetrate into the edge of the sole, or into the upper of the boot. As a result the boot sole tends to remain in contact with the base 2.

Preferably, the friction plate 22 is a piece affixed to the inner surface 12. An affixation surface 31 of the friction plate 22 takes support on the inner surface 12 of the first edge 10. Ribs 32, 33, 34 of the fiction plate 22, projecting with respect to the affixation surface 31, are housed in cavities 35, 36, 37 of the first lateral edge 10. Preferably, the shapes of the ribs and of the cavities are complementary.

The affixing of the friction plate 22 to the lateral edge 10 is obtained, for example, by a gluing of the affixation surface 31 on the inner surface 12, by a tight assembly of the ribs 32, 33, 34 of the friction plate 22 in the cavities 35, 36, 37 of the edge 10, or by a combination of these means.

The other friction plates 21, 23, 24, 25 have structures similar to the second plate 22, and are affixed to the device 1 in the same manner.

As shown in FIG. 1, the first 21 and third 23 plates are located at the level of the front linkage 15. The second 22 and fourth 24 plates are located in the area of the rear linkage 16. The fifth plate 25 is located toward the rear of the device 1, beneath the rear support element 17. Thus, the linkages 15, 16 push portions of the boot directly on the plates.

When the user steers the board, the movements of the boot with respect to the device are braked. As a result, the steering of the board is more accurate.

The other examples of embodiment of the invention are briefly presented by means of FIGS. 5–9. Only the differences with respect to the first embodiment are shown.

Figure 5:
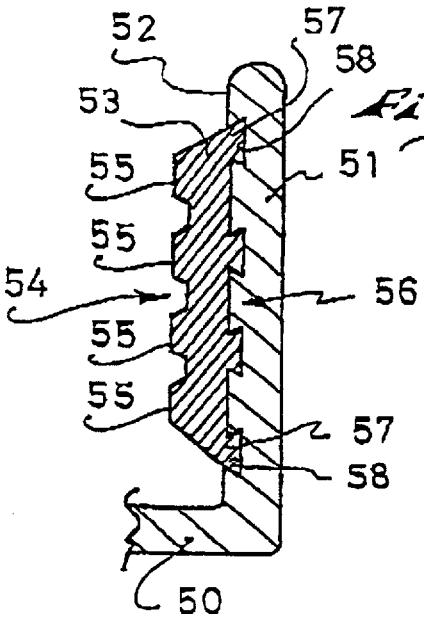
FIG. 5 is similar to FIG. 3, according to a second embodiment.

For the second embodiment, as seen in FIG. 5, a base 50 is extended upward by an edge 51. An inner surface 52 of the edge 51 receives a friction plate 53. The latter has a friction surface 54 having a trapezoidal toothing, whose teeth 55 are substantially parallel to the base 50. An affixation surface 56 of the plate 53 and the edge 51 have dovetail tenons 57 and cutouts 58, respectively, for assembly with one another.

Figure 6:
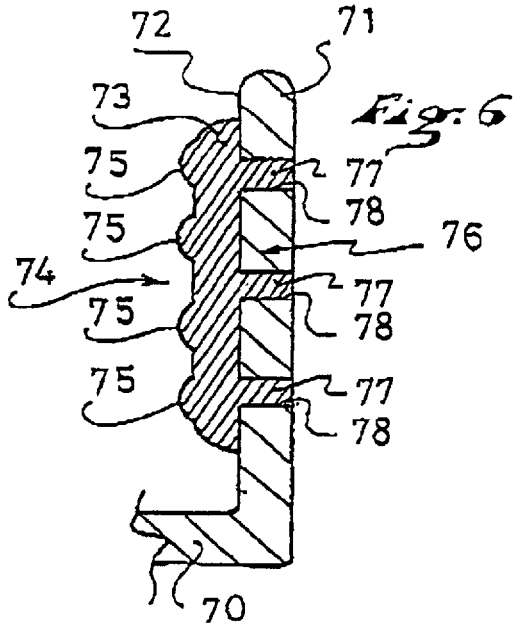
FIG. 6 is similar to FIG. 3, according to a third embodiment.

For the third embodiment, as seen in FIG. 6, a base 70 is extended upward by an edge 71. An inner surface 72 of the edge 71 receives a friction plate 73. The latter has a corrugated friction surface 74, whose projecting portions 75 are substantially parallel to the base 70. An affixation surface 76 of the plate 73 and the edge 71 have ribs 77 and grooves 78, respectively, for assembly with one another.

Figure 7:
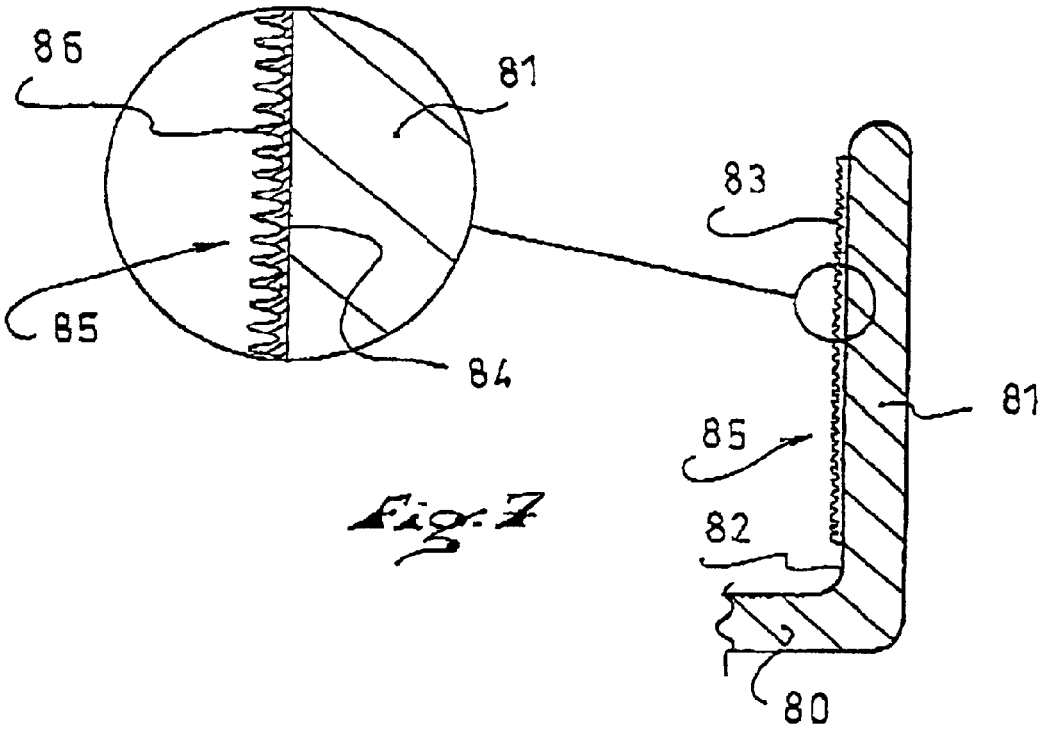
FIG. 7 is similar to FIG. 3, according to a fourth embodiment.

For the fourth embodiment, as seen in FIG. 7, a base 80 is extended upward by an edge 81. An inner surface 82 of the edge 81 receives a friction plate 83. The latter is obtained in the form of a fabric layer. The plate 83, or fabric layer, has a permanent affixation surface 84 opposite a friction surface 85. The permanent affixation surface 84 is affixed to the edge 81, for example, by gluing or by stitching.

The friction surface 85 has a multitude of projecting fingers 86. Each finger, for example, has a length comprised between 0.1 and 3.0 millimeters, and preferably between 0.8 and 2.1 millimeters. The diameter of a finger is comprised, for example, between 0.05 and 1.0 millimeters, and preferably between 0.05 and 0.2 millimeters.

The fingers 86 are juxtaposed so as to form a carpet-like surface. They have the particularity of gripping another similar or identical layer which could be arranged on the boot to be received. The contact of the fabric layer or plate 83 with a similar layer, connected to the boot, strongly brakes the movements of the boot with respect to the device.

A finger 86 can have the shape of a needle or any other shape, such as that of a mushroom, a loop, or the like.

The plate 83 is preferably made of plastic materials.

Figure 8:
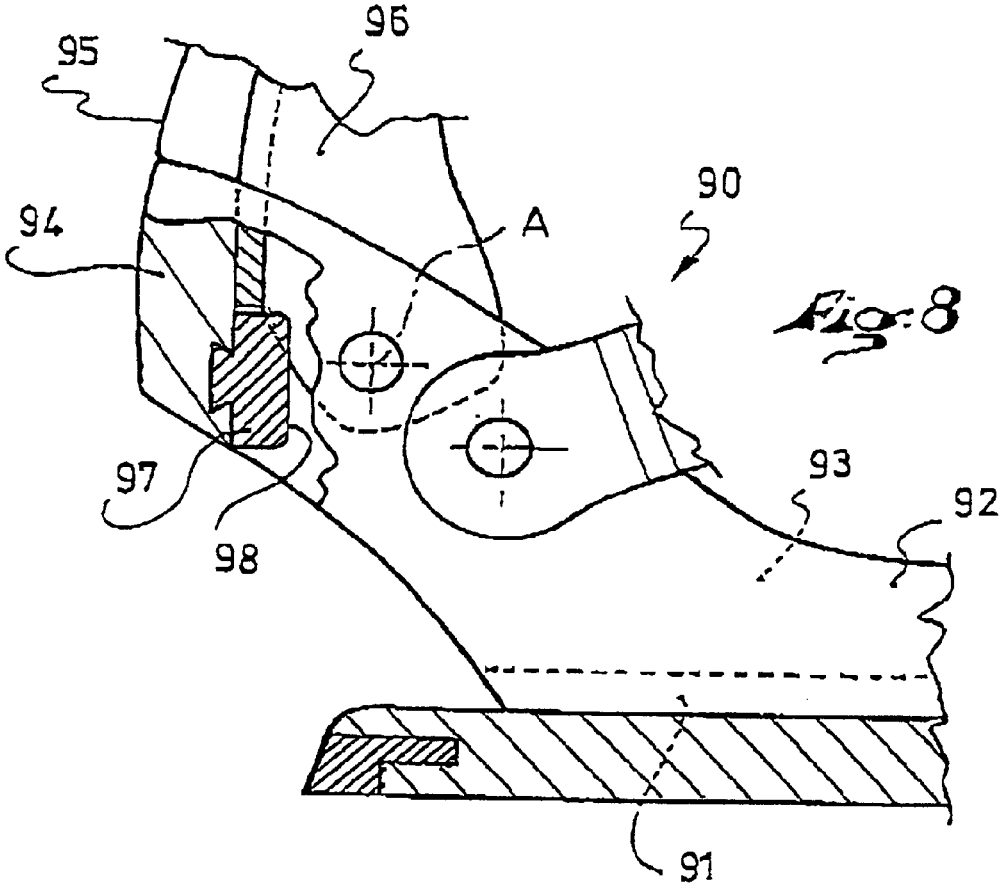
FIG. 8 is a partial side view similar to FIG. 2, according to a fifth embodiment.

The fifth embodiment, presented by means of FIG. 8, only partially shows a retaining device 90.

According to the various embodiments, the invention encompasses a sports board, such as a gliding, rolling, or walking board, used, for example, in snowboarding, skiing, skateboarding, roller skating, snowshoeing, and the like, which includes a device that includes a friction-increasing structure for engagement with the user's boot. The friction-increasing structure can be arranged to project from any of a plurality of parts of a boot-retaining device, as shown in FIG. 1, as an example. In the various examples described, the friction-increasing structure can take the form of a plurality of projections adapted to contact the boot, such projections taking the form, for example, of a plurality of teeth, or a plurality of ribs, or a plurality of fingers, or other non-smooth boot-contacting face.

Figure 4:
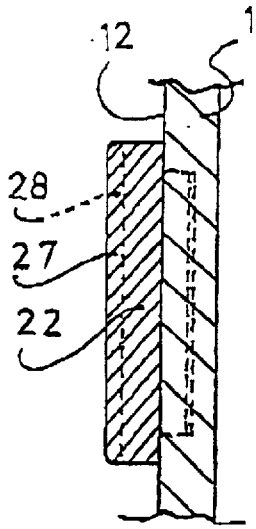
FIG. 4 is a cross-section along the line IV—IV of FIG. 2.

In the examples illustrated in FIGS. 1–7, for example, at least in vertical cross section, the boot-contacting face of the friction-increasing structure, which includes any of surfaces 26, 54, 74, and 85, for example, is nonlinear. Such nonlinearity provides a contacting, or engagement, face for braking the boot with regard to forces that would tend to move the boot away from an upwardly facing support surface of the boot. In a particular example, as shown in FIG. 4, however, in horizontal cross section, the boot-contacting face of the friction-increasing structure can be straight.

The device 90 includes a base 91 overlaid by a first lateral edge 92 and a second lateral edge 93, these edges being connected by an arch 94 toward the rear of the device.

An abutment 95 is affixed to a rear support element 96 to limit a rearward tilting of the latter along the transverse axis A. To this end, the abutment 95 takes support on the arch 94. A friction plate 97 is arranged on the arch 94, such that a friction surface 98 of the plate can rub or press on the boot.

Preferably, the plate 97 projects with respect to the rear support element 96. The plate 97 is affixed to the arch 94 by any means, such as embedding, gluing, screwing, or the like.

In any event, the retaining device can be made out of all of the materials and according to all of the techniques known to a person with ordinary skill in the art.

In particular, the base 2, 91, the lateral edges 10, 11, 92, 93, and the arch 14, 94, preferably form a unitary piece made, for example, of a rigid plastic material. The friction plates are preferably made of a flexible plastic material containing polyurethane, silicon, or rubber. It can also be made of a more rigid plastic material.

Figure 9:
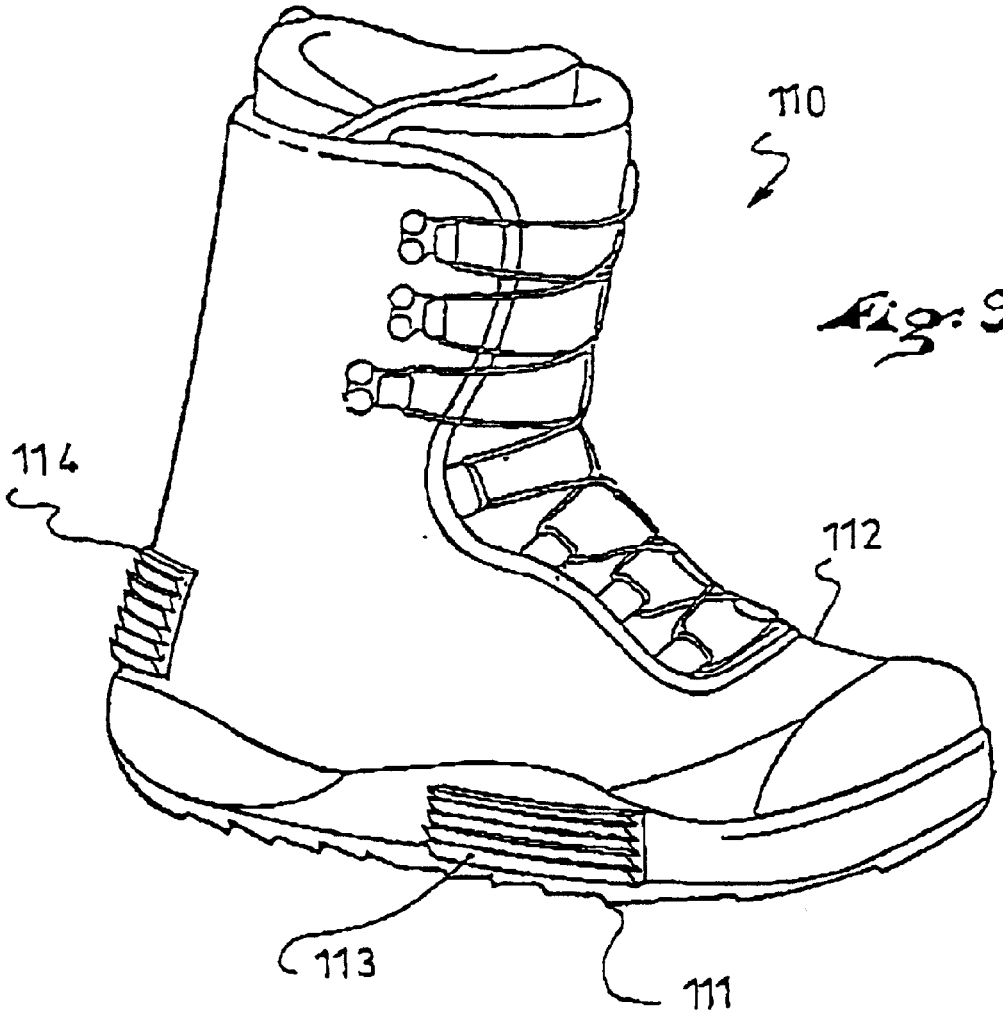
FIG. 9 is a perspective view of a boot adapted to be retained by a device.

A boot 110 adapted to be retained on the device according to the invention is shown in FIG. 9.

The boot 110 has a sole 111 and an upper 112. Any structure is suited to make the boot 110, the sole 111 and the upper 112 being preferably flexible or semi-rigid.

The boot 110 is provided with friction plates identical or similar to those used for the retaining device.

The boot 110 has at least one friction plate that projects at least partially with respect to a lateral portion of the sole and/or with respect to a portion of the upper.

For example, a plate 113 is arranged on one side of the boot, and a plate 114 is arranged at the rear, above the heel or at the level of the heel.

The boot 110 can include one or several friction plates. These plates can be located on any portion of the boot adapted to come into contact with the retaining device. More particularly, as shown in FIG. 9, the friction plate(s) are positioned on one or more exposed portions of the boot such that they can contact part(s) of the retaining device, such as a lateral edge, the arch, or the rear support element.

The invention is not limited to the particular examples described hereinabove, and includes all of the technical equivalents that fall within the scope of the claims that follow.

In particular, one can provide a different number of friction plates, or that a plate be made of a plurality of distinct portions.

One can provide that a plate and the edge or the associated piece form a unitary piece. In this case, the plate is integrated into the structure of the device or of the boot.

The affixation surface of a plate can have protuberances of any shape.

The projections and recesses of the friction surface of a plate can have any suitable shape.

A friction plate can extend over the entire length of an edge of the base or on one side of the boot.

Yet, for the device, the arch can be at the front of the rear support element, and a friction plate can be arranged on the arch to cooperate with the boot.

In any event, to obtain the results according to the invention, the friction plates can be arranged on the device only, on the boot only, or on both the device and the boot.

What is claim is:

1. A device for retaining a boot on a gliding, rolling, or walking board adapted to a sporting activity, the device comprising:

a base provided to receive at least partially a sole of the boot;

at least one lateral edge connected to the base so as to be opposite at least one lateral portion of the boot;

a rear support element provided to receive an upper of the boot at a rear of a user's lower leg; and at least one linkage for holding the boot above the base;

said edge and said rear support element each having an inner surface provided to be opposite the boot, at least one of said inner surfaces having at least one friction plate projecting at least partially with respect to said at least one inner surface, said at least one friction plate having friction means provided at least to oppose a separation of the boot upwardly from said base and to reduce small displacements of the upper of the boot with respect to the device during said sporting activity.

2. A retaining device according to claim 1, wherein:

said at least one friction plate comprises a friction plate projecting with respect to the inner surface of the rear support element.

3. A retaining device according to claim 1, wherein:

said at least one lateral edge comprises first and second lateral edges connected to the base so as to be opposite lateral portions of the boot;

two plates project with respect to an inner surface of the first lateral edge; and two plates project with respect to an inner surface of the second lateral edge.

4. A retaining device according to claim 1, wherein:

the at least one friction plate is made of fabric.

5. A retaining device according to claim 1 in combination with a flexible boot, wherein:

said boot is adapted to a sporting activity and includes:

a sole;

an upper; and at least one friction plate fixed with respect to and projecting at least partially with respect to a lateral outer portion of the sole and/or with respect to an outer portion of the upper, said at least one friction plate being distinct from a remainder of said boot and having a length less than an entirety of a length of the sole or of the upper of the boot, said at least one friction plate of the boot positioned on the boot for engagement with at least said friction plate of said device.

6. A device according to claim 1, wherein:

said friction means comprises a non-smooth boot-contacting surface.

7. A device for retaining a boot on a gliding, rolling, or walking board adapted to a sporting activity, the device comprising:

a base provided to receive at least partially a sole of the boot;

at least one lateral edge connected to said base so as to be opposite at least one lateral portion of the boot;

a rear support element provided to receive a boot upper at a rear of a user's lower leg; and at least one linkage for holding the boot above said base;

said edge and said rear support element each having an inner surface provided to be opposite the boot, at least one of said inner surfaces having at least one friction plate projecting at least partially with respect to said at least one inner surface, said at least one friction plate having means for at least opposing a separation of the boot in relation to said base, said means being constituted by an alternation of projections and recesses arranged on a surface of said friction plate.

8. A retaining device according to claim 7, wherein:

each said projection is a tooth, and wherein the recesses are grooves.

9. A retaining device according to claim 7, wherein:

the teeth and the grooves run over the friction surface, substantially parallel to an upper surface of the base.

10. A device for retaining a boot on a gliding, rolling, or walking board adapted to a sporting activity, the device comprising:

a base provided to receive at least partially a sole of the boot;

first and second lateral edges connected to said base so as to be opposite lateral portions of the boot and an arch connecting said first and second lateral edges at a rear of said base;

a rear support element provided to receive a boot upper at a rear of a user's lower leg; and at least one linkage for holding the boot above said base;

at least one of said first and second lateral edges and said rear support element each having an inner surface provided to be opposite the boot, at least one of said inner surfaces having at least one friction plate projecting at least partially with respect to said at least one inner surface, said at least one friction plate having means for at least opposing a separation of the boot in relation to said base, said friction plate has ribs housed in cavities of said first and second lateral edges, said arch, or said rear support element.

11. A flexible boot adapted to a sporting activity, the boot being adapted to be engaged with inner surfaces of a boot retaining device, said boot comprising:

a sole;

an upper;

at least one friction plate fixed with respect to and projecting at least partially with respect to an outer lateral portion of the sole and/or with respect to an outer portion of the upper for contacting one or more of the inner surfaces of the boot retaining device, said friction plate having a top portion and a bottom portion, said top and bottom portions of said friction plate being positioned against the boot;

said friction plate comprising fabric.

12. A flexible boot according to claim 11, wherein:

said at least one friction plate is/are distinct from a remainder of the boot.

13. A flexible boot according to claim 11, wherein:

said friction plate is positioned on the boot for contact with at least one of the following structural elements of the boot retaining device: one of a pair of upwardly extending lateral edges, an arch connecting the pair of upwardly extending lateral edges, and a rear support element extending upwardly relative to the lateral edges.

14. A flexible boot according to claim 11, wherein:

said friction plate is constituted of an alternation of projections and recesses.

15. A flexible boot according to claim 14, wherein:

said projections are teeth; and said recesses are grooves.

16. A flexible boot according to claim 15, wherein:

said teeth and said grooves extend substantially parallel to a lower surface of said sole.

17. A flexible boot according to claim 11, wherein:

said friction plate is arranged at a rear of the boot.

18. A flexible boot according to claim 11, wherein:

said friction plate is arranged at a side of the boot.

19. A flexible boot according to claim 11, wherein:

said at least one friction plate comprises at least one friction plate arranged at a rear of the boot and at least one friction plate arranged at a side of the boot.

20. A device for retaining a boot on a sports board, said device comprising:

a base having an upwardly facing surface to support a sole of the boot;

at least one lateral edge connected to the base so as to contact at least one lateral portion of the boot;

a rear support element to receive an upper of the boot at a rear of a rider's lower leg, said lateral edge and said rear support element each having an inner side provided to be opposite the boot;

at least one strap to extend over a portion of the boot to hold the boot on the base;

means, secured to and projecting from at least one of said inner sides, for contacting and opposing movement of the boot from said upwardly facing surface of said base and for reducing small displacements of the upper of the boot with respect to the device during use of said sports board.

21. A device according to claim 20, wherein:

said means further comprises means for opposing movement of the boot toward said upwardly facing surface of said base with less force than a force opposing movement of the boot from said upwardly facing surface of said base.

22. A device according to claim 20, wherein:

said means comprises a non-smooth boot-contacting surface.

23. A device for retaining a boot on a sports board, said device comprising:

a base having an upwardly facing surface to support a sole of the boot;

at least one lateral edge connected to the base so as to contact at least one lateral portion of the boot;

a rear support element to receive an upper of the boot at a rear of a rider's lower leg, said lateral edge and said rear support element each having an inner surface provided to be opposite the boot;

at least one strap to extend over a portion of the boot to hold the boot on the base;

means, secured to and projecting from at least one of said inner surfaces, for increasing friction with the boot during movement of the boot from said upwardly facing surface of said base, opposing said movement of the boot from said upwardly facing surface of said base and reducing small displacements of the upper of the boot with respect to the device during use of said sports board, said friction generated by said means being increased relative to friction between the boot and said one of said inner surfaces to which said means is secured.

24. A device according to claim 23, wherein:

said friction means comprises a non-smooth boot-contacting surface.

25. A device for retaining a boot on a gliding, rolling, or walking board adapted to a sporting activity, the device comprising:

a base comprising an upper surface to support and to be opposite a lowermost walking surface of a sole of the boot;

at least one lateral edge connected to the base so as to be opposite at least one lateral portion of the boot;

a rear support element provided to receive an upper of the boot at a rear of a user's leg, said lateral edge and the rear support element each having an inner surface provided to contact the boot;

at least one linkage adapted to extend over the boot to hold the boot on the base;

at least one friction-increasing structure projecting from at least one of the inner surfaces to oppose upward movement of the boot in relation to the upper surface of the base and for reducing small displacements of the upper of the boot with respect to the device during use of the board.

26. A device according to claim 25, wherein:

said friction-increasing structure is constituted by an alternation of projections and recesses.

27. A device according to claims 26, wherein:

each said projection is a tooth; and each said recess is a groove.

28. A device according to claim 27, wherein:

said teeth and said grooves extend substantially parallel to an upper surface of said base.

29. A device according to claim wherein:

said friction-increasing structure comprises ribs housed in cavities of said at least one lateral edge or of said rear support element.

30. A device according to claim 25, wherein:

said at least one lateral edge comprises first and second lateral edges connected to said base so as to be opposite lateral portions of the boot, said device further comprising an arch connecting said first and second lateral edges at a rear of said base; and said friction-increasing structure comprises ribs housed in cavities of said first and second lateral edges, said arch, or said rear support element.

31. A device according to claim 25, wherein:

said at least one lateral edge comprises first and second lateral edges connected to said base so as to be opposite lateral portions of the boot; and said friction-increasing structure comprises two friction plates projecting from an inner surface of said first lateral edge and two friction plates projecting from an inner surface of said second lateral edge.

32. A device according to claim 25, wherein:

said friction-increasing structure comprises a fabric.

33. A device according to claim 32, wherein:

said fabric comprises a multitude of projecting fingers.

34. A device according to claim 33, wherein:

said projecting fingers have a length in a range of 0.1 and 3.0 millimeters.

35. A device according to claim 33, wherein:

said projecting fingers have a diameter in a range of 0.05 and 1.0 millimeters.

36. A device according to claim 25, wherein:

said rear support element is journalled for movement relative to said at least one lateral edge.

37. A device according to claim 25, in combination with a flexible boot, wherein:

said boot is adapted to a sporting activity and includes a sole, an upper, and at least one friction plate projecting from a lateral portion of said sole and/or from a portion of said upper for contact with said friction-increasing structure.

38. A device according to claim 25, wherein:

said at least one lateral edge comprises first and second lateral edges connected to said base so as to be opposite lateral portions of the boot; and said friction-increasing structure comprises at least one friction plate projecting from an inner surface of said first lateral edge and at least one friction plate projecting from an inner surface of said second lateral edge.

39. A device according to claim 25, wherein:

said friction-increasing structure comprises a plurality of projections adapted to contact the boot.

40. A device according to claim 25, wherein:

said friction-increasing structure comprises a layer of material with a plurality of projections adapted to contact the boot, said layer and plurality of projections being a unitary plate, said plate having a surface fixed to said inner surface against movement relative to said inner surface.

41. A device according to claim 25, wherein:

said friction-increasing structure comprises at least one plate fixed to said rear support element, at least said one plate having a plurality of projections adapted to contact the boot.

42. A device according to claim 25, wherein:

said friction-increasing structure has a height extending along said one of said inner surfaces;

a boot-contacting face of said friction-increasing structure, in vertical cross section along an entirety of said height, is nonlinear.

43. A device according to claim 42, wherein:

said friction-increasing structure has a width extending along said one of said inner surfaces;

a boot-contacting face of said friction-increasing structure, in horizontal cross section along an entirety of said width, is straight.

* * * * *